United States Patent [19]

Fullers et al.

[11] 4,098,105

[45] Jul. 4, 1978

[54] METHOD AND APPARATUS FOR SETTING THE VALUE OF THE FORGING DIMENSION IN FORGING PRESSES USING V-DIES AS FORGING TOOLS

[75] Inventors: Detlef Fullers, Monchen-Gladbach, Eduard Schmitz, Dusseldorf, Fed. Rep. of Germany

[73] Assignee: Schloemann-Siemag Aktiengesellschaft, Dusseldorf, both of Fed. Rep. of Germany

[21] Appl. No.: 714,834

[22] Filed: Aug. 16, 1976

[30] Foreign Application Priority Data

Aug. 16, 1975 [DE] Fed. Rep. of Germany ..... 2536532

[51] Int. Cl.[2] ..... B21J 9/20

[52] U.S. Cl. ..... 72/21; 100/48

[58] Field of Search ..... 72/21, 376, 377, 416; 100/43, 48

[56] References Cited

U.S. PATENT DOCUMENTS 3,196,647 7/1965 Schneider ..... 72/21

FOREIGN PATENT DOCUMENTS 1,190,791 5/1970 United Kingdom ..... 72/21

*Primary Examiner*—Lowell A. Larson

*Attorney, Agent, or Firm*—Holman & Stern

[57] ABSTRACT

To set the operation of a forging press having V-dies, so as to produce a desired workpiece dimension after forging, the dimensions of the V-dies and the desired workpiece dimensions are fed into a control circuit. A computer in the control circuit calculates a correction value to be added to the workpiece dimension to obtain a set value for the forging stroke. This set value is passed to valves controlling the operation of the press, and a forging stroke is carried out. The length of the forging stroke is measured, the measured value is compared with the set value in a comparator, and the next forging stroke is initiated when the set and measured values coincide.

1 Claim, 5 Drawing Figures

METHOD AND APPARATUS FOR SETTING THE VALUE OF THE FORGING DIMENSION IN FORGING PRESSES USING V-DIES AS FORGING TOOLS

BACKGROUND OF THE INVENTION

The invention relates to a method and apparatus for correcting the set value of the forging dimension in forging presses with forging tools constructed in V-shape, the forging press being controlled by means of distance-dependent operation of the valves, namely by the top or bottom reversal point being controlled during the forging operation after the comparison of set and measured values, the measured value being provided by a counter and by a transducer which is connected to the tup member, for example by means of a rack, and the set value for the forging dimension (per pass) is provided from the control console to the counter as a numerical value.

It is known that when forging with flat dies the forming surfaces of the top and bottom die are parallel to each other in the horizontal plane. The position when the forming surfaces of the top and bottom die bear on each other is regarded as the reference point or reference plane (zero point) for setting the forging dimension.

The distance between the above-mentioned surfaces in the operating state is measured by means of a digital transducer which is set into rotary motion, for example by a rack that is connected to the tup member, thus producing an electrical distance simulation of the operating stroke in an electric pulse sequence. The measured dimension of the stroke represents the distance between the forming surfaces of the top and bottom die at the end of the stroke and also defines the dimension, after forging, of the workpiece. During forging, the forging dimension is compared by suitable electrical means with a predefined set value. The relative motion between top and bottom die is, at least theoretically, completed when the set value and the measured forging dimension correspond to each other.

Forging with so-called V-dies instead of forging with flat dies has been common practice for several decades. In this kind of forging each of the top and bottom dies is provided with a V-shaped recess to receive the material for forging. The V-shaped recesses are constructed symmetrically to the horizontal plane. When V-dies, with a vertex angle of 90°, meet each other, a square opening will be formed the diagonals of which run vertically and horizontally. The width across flats, i.e. the distance between the two parallel oppositely disposed die surfaces will be represented by d. When the V-dies meet, the width across flats of the square opening will be $d_{min}$. The V-dies can also have vertex angles other than 90°, e.g. 45° or less.

One pair of V-dies permits forging of workpieces which have diameters ranging from $d_{min}$ to $2 \times d_{min}$. This applies to all rectangular, polygonal or round workpieces.

Forging rectangular, polygonal or round sections with V-dies gives rise to the problem that the distance between the forming surfaces (the Veed surfaces) of the bottom and top die does not usually coincide with the forging dimension of the workpiece disposed between the surfaces, because the distance between the forming surfaces is at an angle to the vertical direction of motion of the forging dies. It is not therefore practical to use the distance between the forming surfaces of the top and bottom die either for measuring the forging dimension, or for comparison with a set value as a reference point for the forging dimension.

Instead, based on experience and measurement of the diameter of the workpiece after each manual forging pass, it has become acceptable practice to gradually approach the desired finishing dimension of the workpiece by manually setting the forging dimension.

Such manual operation of the forging press requires, for obvious reasons, a substantial amount of time and results in throughput losses because the available press force of the forging press cannot be fully utilized during the last passes if rejects due to undersized dimensions are to be avoided.

SUMMARY OF THE INVENTION

According to the invention, there is provided a method for correcting the set value of the forging dimension in forging presses with V-shaped forging tools, wherein the values determining the top or bottom reversal point are controlled during the forging operation after the comparison of pre-set and measured values of the stroke, characterized in that the set value of the forging stroke is formed from the addition of the desired forging dimension to a correction value determined for each press pass and defined by the angular position between the plane for measuring the length of stroke and the deformation plane.

The dimension across flats $d_{min}$ and the desired forging dimension $d$ of each forging pass (hereinafter called the "set value") are supplied to an electric function generator. The function generator forms the correcting value for the stroke. The correcting value is subsequently added to the set value of the forging dimension and the sum is fed as an electrical control variable to the measured value sum comparator.

Accordingly, when forging with V-dies as the forging tool it is now possible to approach the predefined forging dimension with a correspondingly corrected stroke accurately in the same way as when forging with flat dies, thus avoiding loss of time when bringing the forging down to its final dimension. The previous risk of obtaining an undersize when finish-forging, i.e. rejects, is also avoided. The forging press can therefore be operated with the optimum throughput rate, even when forging with V-dies.

BRIEF DESCRIPTION OF THE DRAWINGS

The invention will now be further described, by way of example, with reference to the accompanying drawings, in which.

DETAILED DESCRIPTION OF PREFERRED EMBODIMENT

Figure 1:
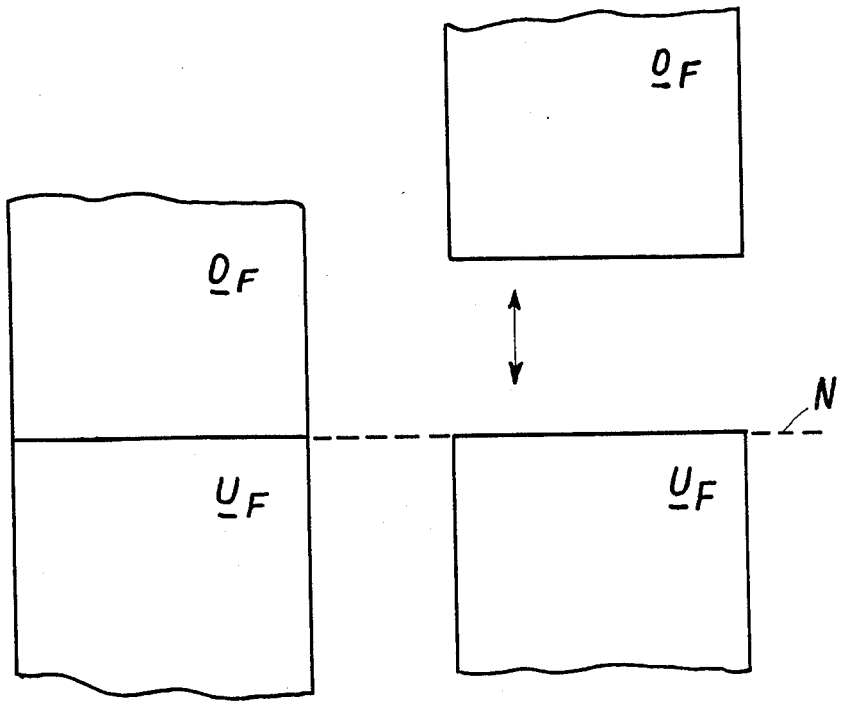
FIG. 1 shows the position of the zero point of the stroke when flat dies are driven together.

In FIG. 1 a top, flat die designated with $O_F$, and a bottom, flat die designated with $U_F$, are shown as forging tools in the closed and open position. Since the stroke in the vertical plane corresponds to the deformation direction, it follows that the mechanical and electrical zero points N coincide in the horizontal plane in which the top flat die $O_F$ bears upon the bottom flat die $U_F$.

Figure 1A:
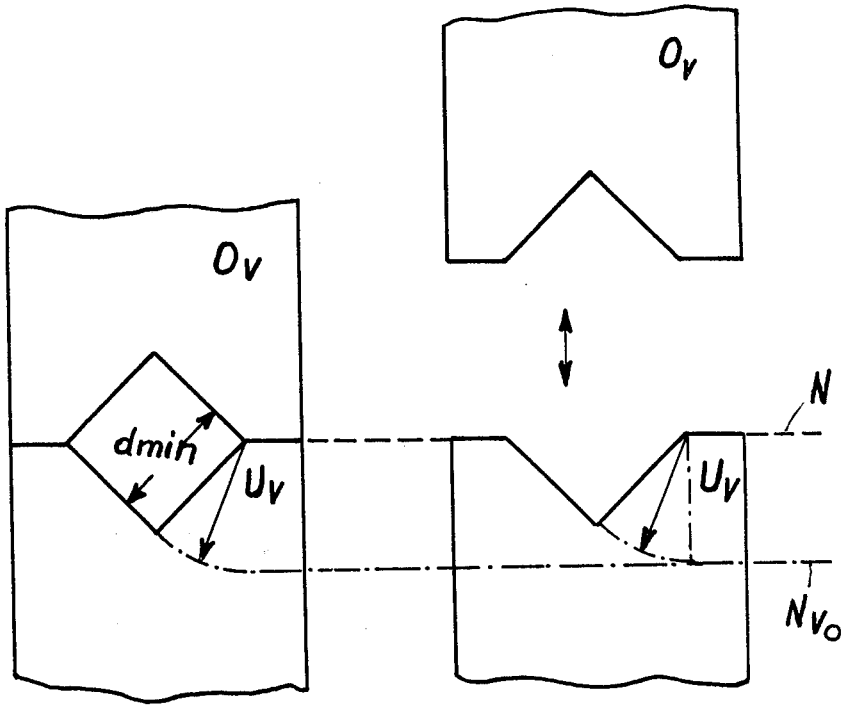
FIG. 1*a* shows the position of the zero point of the stroke when V-dies are driven together.

In FIG. 1*a* a top V-die is designated with $O_V$ and a bottom V-die is designated with $U_V$. When the top V-die $O_V$ and the bottom V-die $U_V$ are driven together, the length $d_{min}$ corresponds to the smallest forging dimension that can be achieved. As can be seen from the opened view of the top V-die $O_V$, the forging stroke in this case is also measured as the length of stroke in the vertical plane in the same way as for flat die forging. When using V-dies as forging tools it is possible for rectangular, polygonal and round profiles having a maximum width across flats of 2 $d_{min}$ to be reduced to a cross section with a width across flats of $d_{min}$. To make appropriate allowance for the geometrical conditions when forging with V-dies as regards electrical measurement of the length of stroke in accordance with the desired cross sectional reduction, it is necessary to locate the electrical zero point for measuring the length of stroke beneath the horizontal parting plane of the forging tools. The new zero point is then designated as the so-called "virtual zero point" $N_{Vo}$.

Figure 2:
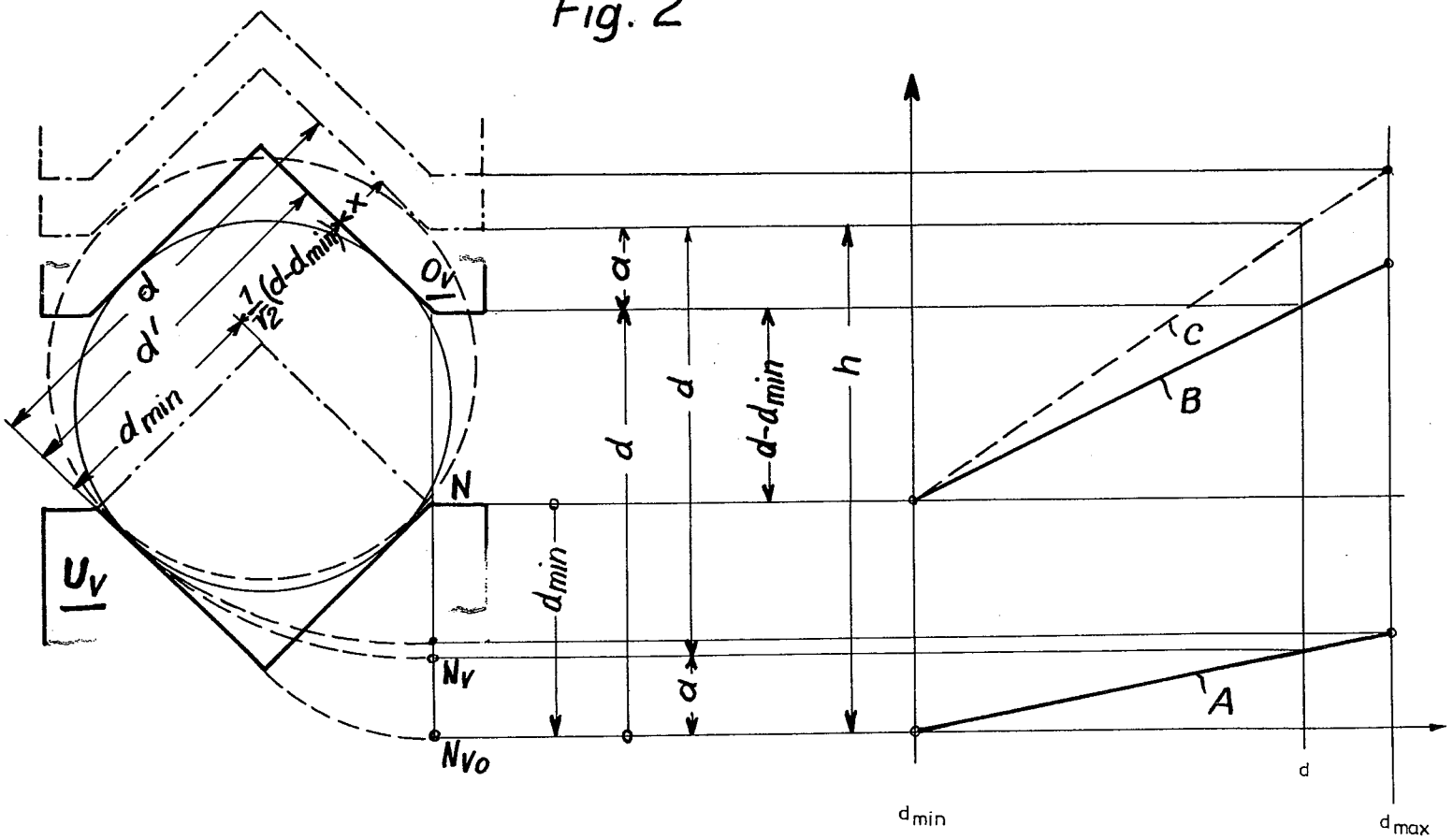
FIG. 2 shows the reference values for deriving the correcting value or the correcting formula which is to be supplied to the function generator.

According to FIG. 2, the actual forging dimension $d'$ resulting from the set forging dimension $d$ is expressed by:

$$d' = d_{min} + (d - d_{min})/\sqrt{2}$$

In the previously known method of forging with V-dies as forging tools, the operating personnel set a larger value for the vertical die motion than would normally be used, with flat dies, for the diameter of the particular workpiece that is to be forged. Hitherto, such setting was made by empirical means and called for repeated check measurements on the forging in order to test its dimensional accuracy.

The relationships between the various dimensions are set out in FIG. 2:

After the zero point is set when the top and bottom dies $O_V$ and $U_V$ are driven together, the zero point N is displaced in the downward direction in the subsequent setting up of the width of opening (width across flats of the V-dies) and the virtual zero point $N_{Vo}$ is defined to form the reference plane for the forging dimension $d'$. The zero point $N_{Vo}$ is fixed, as shown in FIG. 1*a* by taking a radius of length $d_{min}$ from the parting plane of the dies. If the diameter $d$ of the workpiece to be forged is set from the zero point $N_{Vo}$ the top die $O_V$ will move in the upward direction through the distance $d - d_{min}$. However, this movement does not provide the desired forging dimension d but the forging dimension $d'$ which is smaller than the desired forging dimension $d$ by the amount $x$. To obtain the desired forging dimension the top die must therefore move further in the upward direction through the distance $$a = \sqrt{2} \cdot x \quad \text{(Pythagoras)}$$

Now $$x = d - d'$$

and $$d' = d_{min} + d - d_{min}/\sqrt{2}$$

substituting for $x$, and then for $d'$, we obtain:

$$a = \sqrt{2} \cdot [d - (d_{min} + \frac{d - d_{min}}{\sqrt{2}})]$$

and further simplification provides:

$$a = (\sqrt{2} - 1) \cdot (d - d_{min})$$

If the zero point $N_{Vo}$ is displaced upwardly by adding to it distance $a$, in accordance with the above-mentioned function in dependence on the diameter $d$ of the workpiece that is to be forged and if the diameter $d$ of the workpiece to be forged is added to the corrected zero point $N_V$, it will provide the top die position which corresponds to the diameter of the workpiece that is to be forged. This displacement of the zero point accompanied by addition of the set value takes place together with the adjustment of the desired forging dimension and is obtained by an electric function generation which is preferably of the digital type.

If a forging press control system for forging with flat dies is additionally provided with facilities for correcting the zero point in dependence on the diameter of the forged material, a length of stroke $h$, measured from the zero point $N_{Vo}$, will be obtained automatically when forging with V-dies to provide the predefined and preset diameter of the forging.

The following expressions are obtained from the statements above in operation of the forging press:

1. Preset diameter $d$
2. Automatically adjusting correction value for the zero point $N_V a = (\sqrt{2} - 1) \cdot (d - d_{min})$
3. The resultant length of stroke $h$, measured from the original zero point $N_{V_o} = d + a = d + (\sqrt{2} - 1). (d - d_{min})$
4. The workpiece diameter is therefore given as $$d_{min} + \frac{d - d_{min}}{\sqrt{2}} + \frac{a}{\sqrt{2}} =$$

$$d_{min} + \frac{d - d_{min}}{\sqrt{2}} + \frac{(\sqrt{2} - 1)(d - d_{min})}{\sqrt{2}} = d$$

The straight line A in FIG. 2 represents the shift of the zero point $N_{V_o}$ in dependence on the preselected forging dimension $d$ with a given width across flats $d_{min}$.

The straight line B represents the measured forging dimension without the correction value and the straight line C refers to the set forging dimension which corresponds to the sum of the appropriate values A and B for each value. The graph therefore shows that it is possible by means of this method to obtain automatic correction of the measured forging dimension to the set forging dimension without manual manipulation, even when forging with V-dies, so that in terms of control technology, forging with V-dies can be rendered as unproblematic as forging with flat dies.

Figure 3:
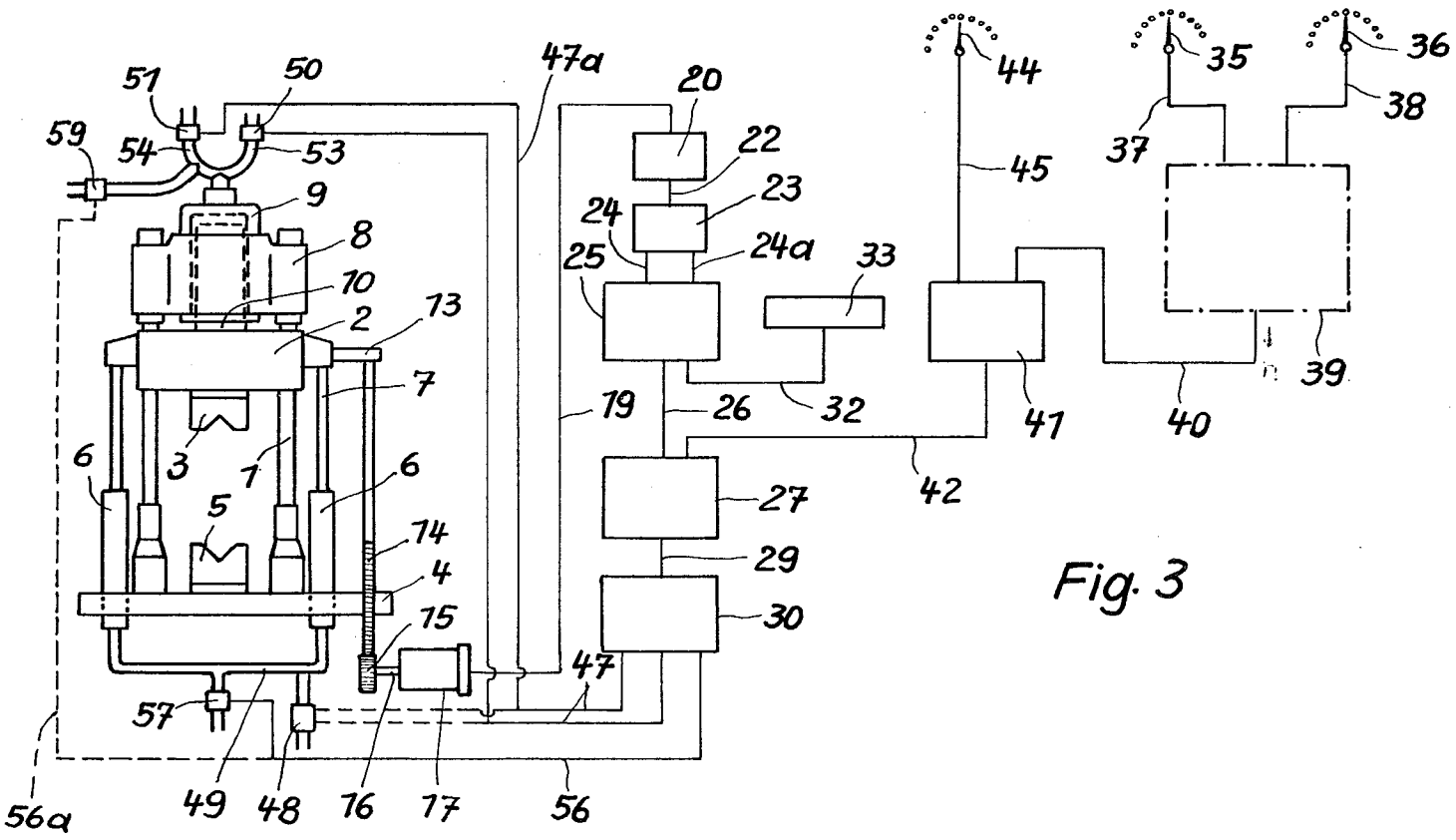
FIG. 3 shows the principle of the forging press control system when forging with V-dies.

Numeral 1 in FIG. 3 refers to the columns of a hydraulic forging press on which a moving crosshead 2 is slidably guided. A top die 3, constructed as a V-die, is detachably connected to the moving crosshead 2. A bottom die 5, also constructed as a V-die and situated opposite to the top die 3, is detachably connected to a bottom crosshead 4 of the forging press. The top die 3 as well as the bottom die 5 together form the forging tool. Return cylinders 6 whose thrust pistons 7 are connected to the moving crosshead 2 are situated on the side of the bottom crosshead 4. A cylinder crosshead 8, adapted to support a press cylinder 9, is mounted on the columns 1. A thrust piston 10 which is guided in the press cylinder 9 is connected by its free end to the moving crosshead 2.

A rack 14 is connected to the moving crosshead 2 by means of a crossbar 13. The teeth of the rack 14 mesh with the gear rim of a pinion 15 which is rotationally coupled through a shaft 16 to a stationary pulse transducer 17, which is preferably a digital distance transducer. The pulse transducer 17 is connected through an electrical connection 19 to a matching amplifier 20 which matches the pulse sequence supplied by the pulse transducer 17 to the electrical level of the contol system in the form of a distance simulation for the movement of the top die 3 with respect to the bottom die 5. A further connection 22 leads from the matching amplifier 20 to a pulse evaluating system 23. This is connected through further connections 24, **24*a* to a forward and reverse counter 25. A further connection 26 leads to a measured value-set value comparator 27 which transmits a signal for reversing the forging press through a connection 29 and through a power amplifier 30** to the appropriate valves of the press control system with each stroke of the press.

The forward and reverse counter 25 is connected through a further connection 32 to an indicating device 33 for the press stroke.

Numeral 35 refers to a BCD encoded switch for setting the desired forging dimension $d$ and numeral 36 refers to a BCD encoded switch for the width across flats $d_{min}$ formed by the V-dies (top die 3 and bottom die 5) between oppositely disposed tool surfaces when they bear upon each other. The operator sets these two swtiches to the appropriate values. Operative connections 37, 38 extend from the switches 35 and 36 to an electronic computer 39 which is constructed as a function generator and will be described in detail with reference to FIG. 4. An operative connection 40 extends from the computer 39 to an adder 41 which is connected through a further operative connection 42 to the measured value-set value comparator 27. A preselector switch 44 for the return stroke (top changeover point) is connected through an operative connection 45 to the adder 41.

Electrical conductors 47 extend from the power amplifier 30 to the control system for a pressure relief valve 48 which is connected to a pressure medium pipeline 49 of the return cylinders 6 and pipeline branches **47*a* extend to pressure supply valves 50, 51. The hydraulic valves 50, 51 are connected to pressure medium pipelines 53, 54 of the pressure cylinder 9. A further electrical conductor 56 extends from the power amplifier 30 to a return valve 57 which is also connected to the pressure medium pipeline 49 and a pipe branch 56*a* is connected to a pressure relief valve 59 which is connected to a branch of the pressure medium supply pipeline 54 of the pressure cylinder 9**.

The computer for providing the forging dimension when using V-dies is described as follows:

As already described, the length of stroke is calculated as $$h = d + (\sqrt{2} - 1) \cdot (d - d_{min}) = d + 0.41421 \cdot (d - d_{min})$$

If $0.41421 \approx 0.4$ the expression $$h = d + 0.4 \cdot (d - d_{min})$$

will give adequate setting accuracy if correction values are taken into account under certain conditions as will be shown subsequently. A relatively simple digital computer can therefore be used which will be described hereinbelow.

The computing operation will be considered by reference to a worked example shown below and with respect to FIG. 4. Appropriate reference points will be stated.

The desired forging dimension d and the opening dimension $d_{min}$ of the V-die are set in BCD encoded switches 35, 36 (BCD = decimal-dual code).

The numerals 0 to 9 of the decimal system are encoded by the corresponding dual numbers in the decimal-dual code:

| Evaluation factor: | $2^3$ | $2^2$ | $2^1$ | $2^0$ |
|---|---|---|---|---|
| 0 | O | O | O | O |
| 1 | O | O | O | L |
| 2 | O | O | L | O |
| 3 | O | O | L | L |
| 4 | O | L | O | O |
| 5 | O | L | O | L |
| 6 | O | L | L | O |
| 7 | O | L | L | L |
| 8 | L | O | O | O |
| 9 | L | O | O | L |

For example, the decimal number 597 is encoded in the BCD code as follows:

OLOL LOOL OLLL.

The value $d_{min}$ is inverted in unit 60 and is added by adding means 61, to the value $d$, thus forming the difference $d - d_{min}$ in the difference former 61. This difference must be multiplied by the constant 0.4. This is achieved by initially dividing by 10 and subsequently by multiplying with 4.

Division by 10 is performed by simple shifting of the digits by one place to the right in the registers 62 and **62*a***. The resultant tens and unit digits on the one hand and the tenth digit on the other hand are separately processed in ensuing computing operations.

The BCD encoded number comprising tens and unit places is converted in a code converter 63 into a dual number. The required multiplication by 4 can be performed in simple manner in a dual number by shifting the bits through two places to the left in a register 64 or 65. The part result is designated as the term 1.

Multiplication of the tenth digit by 4 is performed with adequate accuracy so that the bit with the lowest value (right-hand bit) is neglected and the remaining dual number (3 bits) is added in the form of the term 2 to the term 1 in the adding means 66. This provides the value $0.4 \cdot (d - d_{min})$.

For a number $0.4 \cdot (d - d_{min}) \geqq 32$ the correction value 1 is added by the adding means 67 to provide compensation as far as is necessary for the initially mentioned simplification $0.41421 \approx 0.4$. When $0.4 \cdot (d - d_{min}) \geqq 64$ the result is increased with the adding means 68 by a further 2 and in the case of $0.4 \cdot (d - d_{min}) \geqq 128$ it is increased by a further 2 with the adding means 69.

The calculated value $0.4 \cdot (d - d_{min})$ which may have been increased by the above-mentioned corrections is added by the adding means 71 in the code converter 70 to the forging dimension $d$ which was converted in the code converter 70 from BCD code into dual code.

Figure 4:
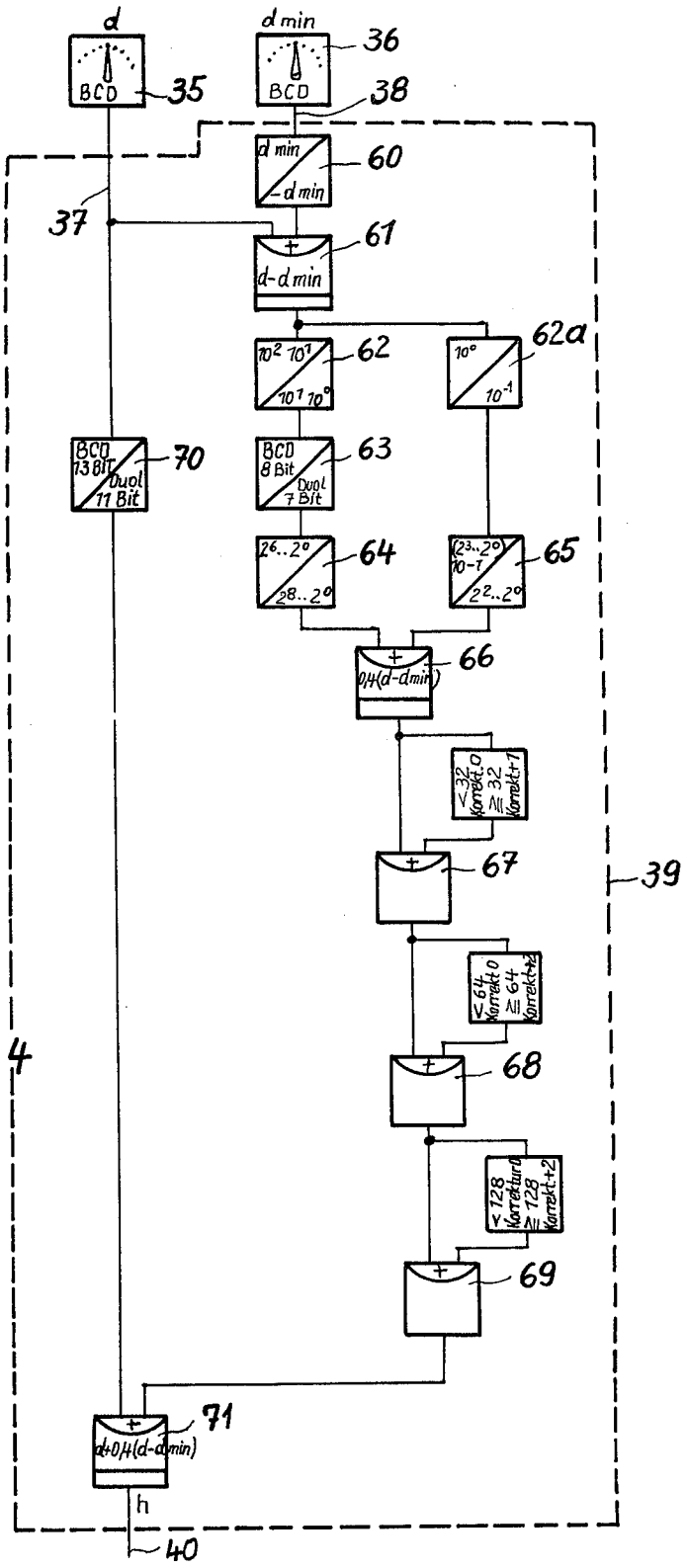
FIG. 4 shows the principle of the controls for the function generator.

The principle of the computer is shown in FIG. 4.

A worked example is reproduced below.

The setting error resulting from the approximation $0.41421 \approx 0.4$ is calculated as follows:

$$f = -\sqrt{2} \cdot \frac{0.4\,(d-d_{min}) - 0.41421\,(d-d_{min})}{d} \cdot 10^3 \text{ [parts per thousand]}$$

The dual code OOLOLOOLO is the decimal 82.

$$f = -\sqrt{2}\ \frac{82 - 0.41421\,(597-400)}{587} \cdot 10^3 \text{ [parts per thousand]}$$

$$= -\sqrt{2} \cdot \frac{82 - 81.59937}{597} \cdot 10^3 \text{ [parts per thousand]}$$

$$= -\sqrt{2} \cdot \frac{400.63}{597} \text{ [parts per thousand]}$$

$$f = -0.95 \text{ [parts per thousand]}$$

Example: Forging dimension $d = 597$ mm; Die dimension $d_{min} = 400$ mm

| d | | | $d_{min}$ | | | | |
|---|---|---|---|---|---|---|---|
| OLOL | LOOL | OLLL | OLOO | OOOO | OOOO | | 35; 36 |
| | | | OLOL | LOOL | OLLL | | |
| | | | −OLOO | OOOO | OOOO | | 60 |
| | | | OOOL | LOOL | OLLL | | 61 |
| | | | | OOOL | LOOL | OLLL | 62; 62 |
| | | | | OOLOOLL | | | 63 |
| | | | | OOLOOLLOO | | | 64 |
| | | | | | | OLL | 65 |
| | | | | OLL | | | |
| | | | | OOLOOLLLL | | | 66 |
| | | | | L | | | |
| | | | | OOLOLOOOO | | | 67 |
| | | | | LO | | | |
| | | | | OOLOLOOLO | | | 68 |
| | | | | LOOLOLOLOL | | | 70 |
| | | | | LOLOLOOLLL | | | 71 |

$h_{decimal} = 2^9 + 2^7 + 2^5 + 2^2 + 2^1 = 2^0 = 512+128+32+4+2+1 = 679$mm $$f = -\sqrt{2} \cdot \frac{h_{0.4} - h_{0.41421}}{d} \cdot 1000 \text{ [parts per thousand]}$$

negative values referring to undersized dimensions and positive values referring to oversize dimensions.

$$f = -\sqrt{2} \cdot \frac{d + 0.4\,(d-d_{min}) - d + 0.41421\,(d-d_{min})}{d} \cdot 10^3 \text{ [parts per thousand]}$$

$$f = -\sqrt{2} \cdot \frac{0.4\,(d-d_{min}) - 0.41421\,(d-d_{min})}{d} \cdot 10^3 \text{ [parts per thousand]}$$

The digitally calculated value, where appropriate taking into account any necessary corrections, is inserted for the value $0.4\,(d-d_{min})$.

When using a V-die of 100 mm the oversize dimension is less than 1.2%, the undersize dimension being less than 9.1 parts per thousand. The following setting errors are obtained for the following die sizes:

| | |
|---|---|
| V-die 150 mm: | oversize dimension <9.1 parts per thousand |
| | undersize dimension <6.1 parts per thousand |
| V-die 250 mm: | oversize dimension <6.3 parts per thousand |
| | undersize dimension <4.8 parts per thousand |
| V-die 400 mm: | oversize dimension <4.3 parts per thousand |
| | undersize dimension <3.6 parts per thousand |

The following error calculation is obtained for the example stated below:

The method of operation of the forging press control system is as follows:

The method of operation of a control system for a V-die forging press is described following the U.S. Pat. No. 3,196,647 in which the control system of a forging press with flat dies as forging tools is already illustrated and described.

Prior to the commencement of the forging operation the top V-die 3 is driven against the bottom V-die 5 and zero point adjustment is performed for the zero point N by means of the pulse transmitter 17. The width across flats $d_{min}$ of the V-dies 3, 5 is subsequently set with the BCD encoded switch 36 and the forging dimension $d$, i.e. the desired set diameter of the forging after the first forging pass, is set with the like-encoded switch 35. The return stroke of the top V-die 3 from its bottom reversing point to its top reversing point during the forging operation is set with the switch 44.

The length of stroke $h$, measured from the virtual zero point $N_{V_0}$, is obtained in the computer 39 in accordance with the function $$h = d + 0.4\,(d-d_{min})$$

from the above-mentioned values for the forging dimension $d$ and for the width across flats $d_{min}$ and is supplied through the operative connection 40 to the adder 41 in the form of a digital value. The return stroke value provided by the BCD encoded switch 44 is added in the adder 41 to the digital value for the forging stroke $h$ which forms the set value for one forging cycle (forward and return stroke) that is transmitted via the operative connection 42 to the comparator 27. Measured and set values of each forging stroke are compared in the comparator 27. For as long as correspondence is maintained for the measured and set value as regards the static value of the forging dimension and the dynamic code sequence of the measured value there will be a corresponding motion of the moving cross-member 2 and of the top forging tool 3 which is constructed as a V-die. This is achieved by actuation of the pressure supply valves 50, 51 and the pressure relief valve 48 through the control pipelines 47, 47*a* or 56, 56*a* by the power amplifier 30 during the forging stroke or operation of the return valve 57 and the pressure relief valve 59 during the return stroke until code equality is obtained in the comparator 27. The measured value of the press stroke is transmitted in dependence on magnitude and direction by the rack 14, which is rigidly connected to the moving cross-member 2, via the pinion 15 on the shaft 16 to the rotating pulse transmitter 17 which supplies a pulse sequence, corresponding to the motion of the moving cross-member, via the connection 19 to the matching amplifier 20. From there the pulse sequence passes via the connection 22 to the pulse evaluating system 23 in which forward and return pulses (depending on the motion of the moving cross-member 2 during the forging stroke or during the return stroke) are separated from each other and are supplied separately through connections 24 or 24*a* to the forward or reverse counter 25. The pulse sequences are transmitted on the one hand through the connection 32 to the numerical display 33 where the appropriate stroke distance is indicated and on the other hand are supplied to the comparator 27 which compares the pulse sequence representing the measured value with the set value fed in through the connection 42 and initiates the next forging stroke of the press in the predetermined manner when the measured and set values coincide.

After each forging pass, i.e. after a sequence of identical forging strokes over the length of the forging, the next value for the forging dimension *d* is preselected with the switch 35 for the next forging pass. This process is repeated until the final forging dimension is achieved.

Through the automatic correction of the length of stroke *h* in accordance with the relationship between the forging or deformation plane of the forged material situated at an angle to the length of stroke measurement in the vertical plane by means of the computer 39, it is possible to embody automatic control even for forging with V-dies, in the same manner as is already practiced when forging with flat dies.

When a forging stroke takes place, the reversal point of the movement of the tups will occur a certain time after the valves have been operated to reverse the movement. The period between operation of the valves and reversal of the tups corresponds to the reaction time of the electrical, mechanical and hydraulic systems of the press.

We claim:

1. A method for setting the operation of a forging press having V-dies, so as to produce a desired workpiece dimension after forging, comprising the steps of:

feeding the width across flats of the V-dies when the dies meet and the desired workpiece dimension into a control circuit;

calculating with a computer in the circuit a correction value to be added to the workpiece dimension to obtain a set value for the forging stroke;

passing the set value for the forging stroke to valves controlling the operation of the press, and performing a forging stroke;

measuring the length of the forging stroke;

comparing the measured value with the set value in a comparator; and initiating the next forging stroke when the set and measured values coincide.

* * * * *